US006713441B1

(12) United States Patent
DeSenna et al.

(10) Patent No.: US 6,713,441 B1
(45) Date of Patent: Mar. 30, 2004

(54) TOILET BOWL CLEANER

(75) Inventors: Richard A. DeSenna, Duluth, GA (US); Hilton G. Dawson, Canton, GA (US); Ryan Griffin Moore, Lilburn, GA (US); Kenneth Scott Wiley, Oakwood, GA (US)

(73) Assignee: Chemlink Laboratories, LLC, Kennesaw, GA (US)

( * ) Notice: Subject to any disclaimer, the term of this patent is extended or adjusted under 35 U.S.C. 154(b) by 201 days.

(21) Appl. No.: 09/808,514

(22) Filed: Mar. 14, 2001

Related U.S. Application Data

(60) Provisional application No. 60/189,526, filed on Mar. 15, 2000, and provisional application No. 60/262,483, filed on Jan. 18, 2001.

(51) Int. Cl.[7] ..... C11D 77/04
(52) U.S. Cl. ..... 510/191; 422/5; 424/76.5
(58) Field of Search ..... 510/191

(56) References Cited

U.S. PATENT DOCUMENTS 4,852,201 A 8/1989 Wundrock et al. ..... 15/145
5,958,334 A 9/1999 Haddon ..... 422/5

*Primary Examiner*—Yogendra N. Gupta
*Assistant Examiner*—John M. Petruncio
(74) *Attorney, Agent, or Firm*—James W. Kayden; Thomas, Kayden, Horstemeyer & Risley, LLP

(57) ABSTRACT

Disclosed is a toilet bowl cleaner that includes a hypochlorite generator and an effervescent system that produces a foam level approximately one inch above a water line in the toilet. The cleaner may be prepared, stored and packaged in a manner that prevents moisture from initiating premature decomposition of the cleaning components. The toilet bowl cleaner may also include a binder, lubricant, fragrance, and a surfactant mixture. Further, the toilet bowler cleaner may be in the form of a tablet, granules, or a powder. The toilet bowl cleaner may also be coated with a surfactant mixture. Also disclosed is a method for producing the toilet bowl cleaner, including the steps of: combining an effervescent system, a hypochlorite generator, and a binder to form a pre-mix; blending the pre-mix in a blender for approximately 15 to 20 minutes; adding a lubricant to the blended pre-mix; and blending the lubricant with the blended pre-mix for approximately three to four minutes to form a cleaner blend. The cleaner blend may then be formed into tablets, granules, or a powder.

31 Claims, No Drawings

TOILET BOWL CLEANER

CLAIM OF PRIORITY

This application claims priority to copending U.S. provisional applications entitled, "Toilet Bowl Cleaner," having Ser. No. 60/189,526, filed Mar. 15, 2000, and "Toilet Bowl Cleaner Effervescent Tablet," having Ser. No. 60/262,483, filed Jan. 18, 2001, which are entirely incorporated herein by reference.

TECHNICAL FIELD

The present invention is generally related to toilet bowl cleaners and, more particularly, is related to a method for preparing toilet bowl cleaners in an effervescent tablet formulation.

BACKGROUND OF THE INVENTION

All toilets found in private residences and public facilities are contaminated by various organic materials that contain or support the growth of various microorganisms. Cleaning alone is not sufficient to kill or inhibit the growth of these organisms and use of disinfectants is necessary.

A disinfectant is a substance that destroys or irreversibly inactivates infectious or other undesirable bacteria, pathogenic fungi, and viruses or surfaces on inanimate objects. Disinfectants kill the growing forms but not necessarily the resistant spore forms of microorganisms. Sterilizers, on the other hand, destroy the growing and spore forms of viruses, bacteria, and fungi on inanimate surfaces. Sanitizers are used to reduce the number of living bacteria or viable virus particles or inanimate surfaces, in water, or in air, and fungicides and fungistats are used to inhibit the growth of or destroy fungi on inanimate surfaces.

The use of disinfectant or sterilant concentrates in a powdered form has been taught in the prior art; for example, in U.S. Pat. No. 5,350,563 to Kralovic et al. The problem with the use of powders as disinfectant concentrates is that they also must be measured in order to prepare the diluted solution and must be poured from one container to another. In addition, there are sometimes problems with forcing the powder into solution.

Certain consumers have found concentrated liquid cleaners to be highly desirable. Important considerations in the selection of a cleaning composition include ease of handling, cleaning ability and stability of the product during storage.

One advantage of liquid cleaners is the ease of handling because liquids can be automatically pumped or dispensed directly to their final use application. Liquid cleaners can also be made into a highly concentrated intermediate aqueous solution that is subsequently flushed/diluted to its proper final use application solution. Liquid cleaners are generally more rapidly soluble than powder or granule cleaners with the same or comparable active ingredients. Liquid cleaners can use higher levels of some surfactants that would cause powders or granules to cake if used at similar levels.

Almost all liquid cleaners have the disadvantage that they are diluted with water, so larger volumes and weights have to be shipped, stored and used to accomplish the equivalent cleaning as a highly concentrated powder or granules. Many liquid cleaners utilize high concentrations of corrosive chemicals which easily spill or splatter on users causing chemical burns, inhalation burns, blindness or discomfort. Liquids can be corrosive to their dispensing equipment by virtue of the caustic alkali being incompatible with pump parts or delivery tubing. Additionally, the ingredients within liquids interact because the ingredient molecules are mobile. These interactions can precipitate or irreversibly inactivate some of the active ingredients upon storage.

One advantage of powder and granular cleaners is the high concentrations of active ingredients because few or no inert ingredients are required. In powder or granular cleaners, high levels of inorganic or organic salts can be used to raise alkalinity and soften water by chelating or sequestering water hardness ions. The powdered or granular cleaners can be used to provide oxidizing agents (bleaches) or reducing agents and granular enzyme materials that can be blended into free flowing powder or granular cleaners. The oxidizing or reducing agents and the enzymes are stable in the powdered or granulated cleaners with no significant loss of activity on extended storage.

A significant disadvantage of powder or granular cleaners for commercial applications is that they are not as accurately controllable in dispensing equipment as liquids. Powder or granular systems can require manually scooping a quantity of powder or granules for each use, thus not taking advantage of the ease, accuracy and hands-off labor savings of liquid dispensers. Also, powders and granules can cake if exposed to high humidity or temperatures. Once they become caked, they cannot be subsequently removed from their shipping container. Powders and granules can lose some of their activity if moistened or exposed to high humidity. Non-homogeneous powders and granules can segregate in their shipping containers, that is, separate or stratify by particle size or density resulting in a non-uniform mixture that may not be appropriate for ultimate use applications. Furthermore, powders and granules can create a safety hazard in that granules or airborne dust particles of irritating or corrosive materials can exit their container or otherwise come in direct contact with tissue, including lung tissue, causing bums or discomfort.

Other patents, for example, those of Hunt et al., U.S. Pat. No. 4,265,847, and White et al., U.S. Pat. No. 4,536,389, teach effervescent tablets useful for preparing solutions for sterilizing or disinfecting. Such compositions are rapid water soluble tablets typically comprising an active chemical compound, an alkali metal bicarbonate, e.g. sodium or potassium bicarbonate, and a solid aliphatic carboxylic acid such as citric acid, tartaric acid, adipic acid, or an acid salt thereof. In use, such tablets are dissolved in water whereupon the interaction of the bicarbonate and acid components results in the release of carbon dioxide, thus increasing the rate of solution of the other components and producing a solution in which the active (disinfecting) ingredient is homogenously dissolved. Methods for forming effervescent tablets are well known in the art. For example, see U.S. Pat. No. 4,265,847 to Hunt et al. and U.S. Pat. No. 5,114,647 to Levesque et al., which disclosures are incorporated herein in their entireties, by reference.

Halogen compounds are effective as disinfecting agents but their use as such agents is limited due to difficulties in storage, mixing, and handling of concentrated halogens and instability of dilute forms. The use of sodium dichloroisocyanurate as a disinfecting agent is known in the prior art. For example, see U.S. Pat. No. 4,536,389, to White et al., and U.S. Pat. No. 5,114,642, to Levesque et al. Sodium dichloroisocyanurate hydrolyses in water to produce hypochlorous acid (HOCl) and hypochlorite ($OCl^-$), which exist in solution at an equilibrium that is dependent upon the pH of the solution.

Accordingly, there is a need for an effective disinfecting agent packaged and supplied in a convenient effervescent form. The effervescent tablet must fully and rapidly dissolve in a rapid fashion to form a homogeneous disinfecting solution that is highly active and stable for a useful length of time, as well as produce a sizeable amount of effervescent foam.

Thus, a heretofore unaddressed need exists in the industry to address the aforementioned deficiencies and inadequacies.

SUMMARY OF THE INVENTION

The present invention provides a toilet bowl cleaner composition and method for making a toilet bowl cleaner composition. Briefly described, the toilet bowl cleaner includes a hypochlorite generator and an effervescent system that produces a foam level approximately one inch above a water line in a toilet bowl. The toilet bowl cleaner of the present invention may be prepared, stored and packaged in a manner that prevents moisture from initiating premature decomposition of the cleaning components. Typically, the effervescent system used in the toilet bowl cleaner includes an alkali metal carbonate and an acid. The toilet bowl cleaner may further include any one or more of the following ingredients: a lubricant, a binder, a fragrant, and a surfactant mixture. The toilet bowl cleaner of the present invention may be prepared in tablet, granular, or powder form. If prepared in tablet or granular form, the toilet bowl cleaner may further be coated with a surfactant mixture.

The present invention can also be viewed as a method for producing the toilet bowl cleaner. In this regard, the method can be broadly summarized by the following steps: combining an effervescent system, a hypochlorite generator, and a binder to form a pre-mix; blending the pre-mix in a blender for approximately 15 to 20 minutes; adding a lubricant to the blended pre-mix; and blending the lubricant with the blended pre-mix for approximately three to four minutes to form a cleaner blend. At this point in the process, the cleaner blend may then be formed into tablets, granules, or a powder.

If made into tablet form, the present invention may further include the steps of feeding the cleaner blend into a tablet press and forming tablets of approximately 30 to 50 grams each. The present invention also includes the process of the optional steps of coating the tablets with a surfactant mixture by placing the tablets on a belt, turning the tablets on their edge in order to enable coating of the tablets, and coating the tablets with a surfactant. The method of making the toilet bowl cleaner tablets may also include the additional optional steps of passing the tablets into a cooling chamber and packaging the tablets in individual moisture-impervious pouches.

The present invention can also be viewed as providing a method for forming the toilet bowl cleaner in granular form. The method can be broadly summarized by the following steps: placing the cleaner blend in a granulator unit, compacting and milling the cleaner blend into granules; passing the granules over a classifier; separating the granules into classes of various sizes; and packaging the granules of the desired size in moisture-impervious pouches.

Other compositions, methods, features, and advantages of the present invention will be or become apparent to one with skill in the art upon examination of the following detailed description. It is intended that all such compositions, methods, features, and advantages be included within this description, be within the scope of the present invention, and be protected by the accompanying claims.

DETAILED DESCRIPTION OF THE INVENTION

There is a need for an effective disinfecting agent packaged and supplied in a convenient effervescent form. The effervescent tablet or granules must fully and rapidly dissolve to form a homogeneous disinfecting solution that is highly active and stable for a useful length of time, as well as produce a sizeable amount of effervescent foam. It has been heretofore unknown in art how to produce a toilet bowl cleaner in tablet or granular form that can dissolve in less than five minutes, and produce significant effervescent foam in the toilet bowl.

The present invention provides a non-liquid toilet bowl cleaner in tablet or granular form, and a method of preparing the cleaner. The toilet bowl cleaner may be contained in a single application atmospheric-resistant pouch. The single application pouch provides a convenient and compact, yet safe, way to keep and store the toilet bowl cleaner of the present invention. To activate the toilet bowl cleaner, the cleaner may be placed directly into the toilet bowl. Generally, a single application pouch may contain a pre-measured amount of cleaner to clean a 1.5-liter toilet bowl. The cleaner dissolves in the water in less than approximately 5 minutes. An indication of dissolution is cessation of the effervescence. The effervescent foam level is approximately one inch above the water line in the toilet bowl, a significant amount that has been heretofore unknown in the art.

The toilet bowl cleaner is carefully prepared, stored, and packaged to prevent moisture from initiating premature decomposition of the cleaning components, and thereby rendering it less effective. The toilet bowl cleaner is normally produced in a moisture-controlled atmosphere. The moisture-controlled environment inhibits the active ingredients from absorbing moisture from the air. Thus, the preparation and packaging of the toilet bowl cleaner can decrease the possibility of premature decomposition.

The toilet bowl cleaner includes at least one hypochlorite generator and an effervescent system. Additionally, at least one binder, lubricant, and fragrance can be included in the toilet bowl cleaner. Further, the toilet bowl cleaner may have a coating of a dry surfactant mixture on the tablet or on the granules.

The hypochlorite generator used in the toilet bowl cleaner may include, but is not limited to, one or more or all of the following: chlorinated isocyanurates, calcium hypochlorite, lithium hypochlorite, magnesium hypochlorite, alkali earth metal hypochlorites, and alkaline earth metal hypochlorites. More particularly, the hypochlorite generator used in the preferred embodiment is an anhydrous form of dichloroisocyanurate. The hypochlorite generator represents 0.5–5% by weight of the total weight of the toilet bowl cleaner.

In addition, the toilet bowl cleaner includes an effervescent system. The effervescent system may include, for example, but is not limited to, one or more of an alkali metal carbonate and an acid. The one or more alkali metal carbonates may be selected from the following: sodium carbonate, sodium bicarbonate, potassium carbonate, and potassium bicarbonate. More particularly, sodium bicarbonate is used as the alkali metal carbonate. Furthermore, one or more acids may be selected from the following: citric; maleic; fumaric; adipic; potassium or sodium phosphate, monobasic; oxalic; lactic; sulfamic; tartaric acid; sodium bisulfite; and sodium or potassium pyrophosphate. In a preferred embodiment, citric acid is used as the acid. If using the alkali metal carbonate and the acid as the effervescent system, then the effervescent system, which is the summation of the alkali metal carbonate and the acid, represents approximately 50–90% by weight of the total weight of the toilet bowl cleaner.

Furthermore, the toilet bowl cleaner may include a lubricating agent, which limits sticking to other tableting or granulating equipment during the manufacturing process. The lubricant that may be used can be selected from, but is not limited to, the following: sodium benzoate, stearates, polyethylene glycols, mineral oil, silicates, or algenic acid. In a preferred embodiment, sodium benzoate is used as the lubricating agent. The lubricant represents 0–5% by weight of the total weight of the toilet bowl cleaner.

In addition, the toilet bowl cleaner may include a binder. The binder that may be used can be selected from, but is not limited to, the following: polyethylene glycol, sorbitol, maltodextrin, or other sugars (e.g., lactose, sucrose). In a preferred embodiment, sorbitol and polyethylene glycol are used as the binders. The binders represent approximately 0–20% by weight of the total weight of the toilet bowl cleaner.

Additionally, the toilet bowl cleaner may include a surfactant mixture. The surfactant mixture may include, but is not limited to, alkylated, sulfonated diphenyl oxide; disodium salt; sodium lauryl sulphate; and alkyl benzene sulfonates. The surfactant mixture of the preferred embodiment includes a $C_{12-20}$ ethoxylated alcohol, preferably the surfactant Rhodosurf TB970™, manufactured by and commercially available from Rhodia Inc., Cranbury, Conn.; and a sodium $C_{14-16}$ olefin sulfonate, preferably Bioterge AS90™, manufactured by, and commercially available from Stephan Company, Northfield, Ill. The surfactant may represent approximately 0. 1–5% by weight of the total weight of the toilet bowl cleaner.

Further, a dry surfactant mixture may be added to the toilet bowl cleaner formulation, or added as a coating to the tablets. The surfactant mixture that may be used includes, for example, but is not limited to, alkylated, sulfonated diphenyl oxide; disodium salt; sodium lauryl sulphate; and alkyl benzene sulfonates. The surfactant mixture of the preferred embodiment includes the surfactant Rhodosurf TB970™, glycerin, the amine oxide Monolux CA035™, manufactured by and commercially available from ICI Chemicals & Polymers Ltd., New Castle, Del., and the monoethanol amine Monamid CMA™, manufactured by and commercially available from ICI Chemicals & Polymers Ltd., New Castle, Del. The surfactant represents approximately 0.4–5% by weight of the total weight of the toilet bowl cleaner.

Tables 1 and 3 below list the ingredients of two exemplary embodiments of the invention, as well as the approximate weight percent of each ingredient.

TABLE 1

Ingredients of a First Exemplary Embodiment

| Ingredient | Approximate Weight Percent (%) |
|---|---|
| Citric Acid (fine granular) | 30.8 |
| Sodium Bicarbonate | 50 |
| Carbowax 8000 ™ | 5 |
| Dichloroisocyanurate | 1.7 |
| Sodium Benzoate | 2 |
| Lemon Fragrance (pre-mix) | 0.5 |
| Sorbitol | 10 |

The present invention also relates to the method of producing the toilet bowl cleaner tablet. The method first involves adding all of the ingredients in Table 1, except for sodium benzoate, to a V-, or Hobart blender and blending for approximately 15 to 20 minutes. Sodium benzoate is then added and the mixture is blended for approximately an additional three to four minutes. Next, the blend is fed into a tablet press and tablets of approximately 30–50 grams (g) each are formed. The tablets then leave the press and go on to a belt that may turn the tablets on their edge for the optional coating step. Subsequently, the tablets enter a chamber that coats each tablet with a surfactant. Several factors may be controlled within the chamber, including the following: the size of the orifice opening in the spray nozzle; the pressure on the system, so that atomization of the surfactant is proper; the temperature, remaining at least approximately 60° C.; the rate-speed of the belt as the tablets move through the chamber, which in turn affects the exposure time of each tablet. Upon leaving the chamber, each tablet will have a very thin, even coating of surfactant. The process may include optional steps of preparing the tablet to be sold to the consumer. For example, but not limited to these steps, the tablets may be passed into a cooling chamber, packaged in individual moisture-impervious pouches, and then boxed for shipment.

Table 2 below lists the ingredients of the preferred embodiment of the surfactant mixture. A coating of approximately 0.1–2.5 g is disposed upon each tablet.

TABLE 2

Ingredients of Surfactant Mixture.

| Ingredients | Approximate Weight (g) |
|---|---|
| Rhodosurf TB970 ™ | 40 |
| Glycerin | 10.6 |
| Monolux CA035 ™ | 6.0 |
| Monamid CMA ™ | 0.4 |

Table 3 below lists the ingredients of an exemplary embodiment of the toilet bowl cleaner, and approximate weight percent of each ingredient of the toilet bowl cleaner.

TABLE 3

Ingredients of a Second Exemplary Embodiment

| Ingredient | Approximate Weight Percent (%) |
|---|---|
| Citric acid (fine granular) | 30.6 |
| Sodium bicarbonate | 45.0 |
| Potassium bicarbonate | 5.0 |
| Carbowax 8000 ™ | 5.0 |
| Sorbitol | 9.9 |
| Sodium dichloroisocyanurate | 1.7 |
| Sodium benzoate | 2.0 |
| Bioterge ™ | 0.2 |
| Rhodasurf ™ | 0.07 |

The present invention also relates to a method of producing the toilet bowl cleaner in tablet form without a coating on the tablet. The method first involves adding all of the ingredients in Table 3, except for sodium benzoate, to a V-, or Hobart blender and blended preferably at least approximately 20 minutes. Sodium benzoate is then added and the mixture is blended for approximately an additional three to four minutes, and the composition is then pressed into tablets. The process may include optional steps of preparing the tablet to be sold to the consumer. For example, but not limited to these steps, the tablet may be packaged in individual moisture-impervious pouches, and then boxed for shipment.

The present invention also includes a method of producing the toilet bowl cleaner in granular form. The method first involves adding all of the ingredients in Table 3, except for sodium benzoate, to a V-, or Hobart blender and blended for at least approximately 20 minutes. Sodium benzoate is then added and the mixture is blended for approximately an additional three to four minutes. The ingredients are then placed in a granulator unit that compacts and mills the ingredients into granules. The granules may then be passed over a classifier, after which the granules of the desired size are placed into moisture-impervious pouches. Many different types of granulator units may be used to produce the granules of the present invention. The granulator may include for example, but is not limited to, either a roll compactor- or an extruder-type of granulator.

It should be emphasized that the above-described embodiments of the present invention, particularly, any "preferred" embodiments, are merely possible examples of implementations, and merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

Therefore, having thus described the invention, at least the following is claimed:

1. An effervescent toilet bowl cleaner in powder, granular, or tablet form, comprising:

a chlorinated isocyanurate that comprises approximately 0.5 to 5% by weight of the cleaner; and an effervescent system that produces a foam level approximately one inch above a water line in a toilet bowl.

2. The cleaner of claim 1, wherein the toilet bowl cleaner is prepared, stored and packaged in a manner that prevents moisture from initiating prematire decomposition of the cleaning components.

3. The cleaner of claim 1, wherein the chlorinated isocyanurate is dichloroisocyanurate.

4. The cleaner of claim 1, wherein the effervescent system comprises:

an alkali metal carbonate; and an acid.

5. The cleaner of claim 4, wherein the alkali metal carbonate is selected from the group consisting of: sodium carbonate, sodium bicarbonate, potassium carbonate, and potassium bicarbonate.

6. The cleaner of claim 4, wherein the acid is selected from the group consisting of: citric; maleic; fumaric; adipic; potassium phosphate, monobasic; sodium phosphate, monobasic; oxalic; lactic; sulfamic; tartaric; sodium bisulfite; sodium pyrophospbate; and potassium pyrophosphate.

7. The cleaner of claim 1, wherein the effervescent system comprises approximately 50 to 90% by weight of the cleaner.

8. The cleaner of claim 1, further comprising a lubricant.

9. The cleaner of claim 8, wherein the lubricant is selected from the group consisting of: sodium benzoate, stearates, polyethylene glycols, mineral oil, silicates, and algenic acid.

10. The cleaner of claim 8, wherein the lubricant comprises approximately 0.1 to 5% by weight of the cleaner.

11. The cleaner of claim 1, further comprising a binder.

12. The cleaner of claim 11, wherein the binder is selected from the group consisting of: polyethylene glycol, sorbitol, maltodextrin, and other sugars.

13. The cleaner of claim 11, wherein the binder comprises approximately 3 to 20% by weight of the cleaner.

14. The cleaner of claim 1, further comprising a fragrance.

15. The cleaner of claim 1, further comprising a surfactant mixture.

16. The cleaner of claim 15, wherein the surfactant mixture comprises one or more surfactants selected from the group consisting of: alkylated, sulfonated diphenyl oxide; disodium salt; sodium lauryl sulphate; an alkyl benzene sulfonate; sodium $C_{12-20}$ ethoxylated alcohol; and sodium $C_{14-16}$ olefin sulfonate.

17. The cleaner of claim 15, wherein the surfactant mixture comprises approximately 0.1 to 5% by weight of the cleaner.

18. The cleaner of claim 1, wherein the granular or tablet cleaner is coated with a surfactant mixture.

19. The cleaner of claim 18, wherein the surfactant mixture coating comprises one or more surfactants selected from the group consisting of: alkylated, sulfonated diphenyl oxide; disodium salt; sodium lauryl sulphate; an alkyl benzene sulfonate; glycerin; an amine oxide; and a monoethanol amine.

20. The cleaner of claim 18, wherein the surfactant mixture coating comprises approximately 0.4 to 5% by weight of the cleaner.

21. The cleaner of claim 18, wherein the cleaner is a tablet and the surfactant mixture coating comprises:

a $C_{12-20}$ ethoxylated alcohol;

glycerin;

an amine oxide; and a monoethanol amine.

22. A toilet bowl cleaner in powder, granular or tablet form, comprising:

citric acid comprising approximately 30% by weight of the cleaner;

sodium bicarbonate comprising approximately 50% by weight of the cleaner;

polyethylene glycol comprising approximately 5% by weight of the cleaner;

dichloroisocyanurate comprising approximately 2% by weight of the cleaner;

sodium benzoate comprising approximately 2% by weight of the cleaner;

fragrance comprising approximately 0.5% by weight of the cleaner; and sorbitol comprising approximately 10% by weight of the cleaner.

23. A toilet bowl cleaner in powder, granular or tablet form, comprising:

citric acid comprising approximately 30% by weight of the cleaner;

sodium bicarbonate comprising approximately 45% by weight of the cleaner;

potassium bicarbonate comprising approximately 5% by weight of the cleaner;

polyethylene glycol comprising approximately 5% by weight of the cleaner;

dicholorisocyanurate comprising approximately 2% by weight of the cleaner;

sodium benzoate comprising approximately 2% by weight of the cleaner;

sorbitol comprising approximately 10% by weight of the cleaner;

a sodium $C_{14-16}$ olefin sulfonate comprising approximately 0.2% by weight of the cleaner; and a $C_{12-20}$ ethoxylated alcohol comprising approximately 0.07% by weight of the cleaner.

24. A method of producing a toilet bowl cleaner in granular or tablet form, comprising the steps of:

combining an effervescent system and a chlorinated isocyanurate, wherein the chlorinated isocyanurate comprises approximately 0.5 to 5% by weight of the cleaner;

blending the pre-mix in a blender for approximately 15 to 20 minutes;

adding a lubricant to the blended pre-mix; and blending the lubricant with the blended pre-mix for approximately three to four minutes to form a cleaner blend.

25. The method of claim 24, further comprising the steps of:

feeding the cleaner blend into a tablet press; and forming tablets of approximately 30 to 50 grams each.

26. The method of claim 25, further comprising the steps of:

placing the tablets on a belt; and coating the tablets with a surfactant.

27. The method of claim 26, wherein the step of coating the tablets with a surfactant comprises coating the tablets with a surfactant mixture coating comprising one or more surfactants selected from the group consisting of: alkylated, sulfonated diphenyl oxide; disodium salt; sodium lauryl sulphate; an alkyl benzene sulfonate; glycerin; an amine oxide; and a monoethanol amine.

28. The method of claim 26, wherein the step of coating the tablets with a surfactant comprises:

placing the tablets in a chamber comprising a spray nozzle including an orifice from which the surfactant is sprayed onto the tablet; and controlling conditions in the chamber, wherein the conditions comprise the size of the orifice in the nozzle, the pressure in the chamber, the temperature in the chamber, and the rate-speed of the belt as the tablets move through the chamber.

29. The method of claim 26, further comprising the steps of:

passing the tablets into a cooling chamber; and packaging the tablets in individual moisture-impervious pouches.

30. The method of claim 24, further comprising the steps of:

placing the cleaner blend in a granulator unit; and compacting and milling the cleaner blend into granules.

31. The method of claim 30, further comprising the steps of:

passing the granules over a classifier;

separating the granules into classes of various sizes; and packaging the granules of the desired size in moisture-impervious pouches.

* * * * *